US005297957A

United States Patent [19]

Brashears

[11] Patent Number: 5,297,957

[45] Date of Patent: Mar. 29, 1994

[54] ORGANIC WASTE INCINERATOR

[75] Inventor: David F. Brashears, Belle Isle, Fla.

[73] Assignee: Thermotech Systems Corp., Orlando, Fla.

[21] Appl. No.: 897,051

[22] Filed: Jun. 11, 1992

[51] Int. Cl.[5] ..... F27D 7/00

[52] U.S. Cl. ..... 432/14; 432/28; 432/125; 432/107; 432/215

[58] Field of Search ..... 432/215, 103, 105, 106, 432/107, 111, 14, 117, 118, 28; 110/246

[56] References Cited

U.S. PATENT DOCUMENTS

| | | | |
|---|---|---|---|
| 2,986,475 | 5/1961 | Jones | 432/28 |
| 3,080,156 | 3/1963 | Freeman | 432/28 |
| 3,578,417 | 5/1971 | Dale | 432/28 |
| 3,630,501 | 12/1971 | Shabaker | 432/215 |
| 4,154,574 | 5/1979 | Keirle et al. | 432/107 |
| 4,191,530 | 3/1980 | Bearce | 432/107 |
| 4,422,847 | 12/1983 | Propster et al. | 432/215 |
| 4,600,379 | 7/1986 | Elliott | 432/13 |
| 4,787,938 | 11/1988 | Hawkins | 106/281 |
| 4,859,177 | 8/1989 | Kreisberg et al. | 432/105 |
| 4,913,552 | 4/1990 | Bracegirdle | 432/105 |
| 5,018,459 | 5/1991 | Judd | 110/346 |
| 5,054,406 | 10/1991 | Judd | 110/346 |

*Primary Examiner*—Henry C. Yuen
*Attorney, Agent, or Firm*—Nixon & Vanderhye

[57] ABSTRACT

Heated surrogate medium is placed in heat transfer relation with high moisture content waste material where water is evaporated to steam. By agitating the mixture of waste material and heated surrogate medium, particulate matter from the waste material is entrained in the steam. A separator separates the steam and dried waste material and supplies the dried waste material to a burner for heating the surrogate medium. The separated steam flows to a stack or to the surrogate medium and oversized waste material discharged through an outlet of the drying zone for flowing additional particulate material from the waste material flowing through the discharge outlet back into the drying zone. The discharged surrogate medium and the oversized waste material are separated and the separated surrogate medium is recycled into the heating zone.

21 Claims, 2 Drawing Sheets

ORGANIC WASTE INCINERATOR

BACKGROUND AND SUMMARY OF THE INVENTION

The present invention relates to drying, and in most cases incineration, of certain organic waste or other materials, notably those which have a high moisture content requiring the material to be dried prior to incineration. These materials may comprise, for example, waste products such as pulp or paper sludge, green wood sawdust, sewage sludge and the like. It is not uncommon for these wastes to have over 50–60% by weight moisture content which makes clean incineration difficult. Because of the substantial cost of auxiliary, high BTU, fuels, such as gas and oil, it is difficult to economically justify pre-drying these materials to the extent that the moisture content is desirably reduced to about 10% by weight.

Historically, waste materials of these types have been incinerated in mass burn environments where they are dried and burned in the same chamber or in some type of continuous basis where the moisture evaporated from the materials continues through the incineration zones. This creates a problem with the incineration, because the water vapor tends to suppress the furnace temperature and reduce the volume percentage of available oxygen around the burnable portions. This has led to serious consequences in some cases because low temperature combustion and low oxygen availability can lead to the generation of intermediate stage gaseous combustion products, some of which may be halogenated, which continue through the process and are expelled from the system as pollutants with the stack gases. In many cases, it has been necessary to add a high initial purchase and operating cost fume incinerator in the exhaust gas stream to fully oxidize these evolved compounds, eliminating their emission to the atmosphere. These volatile organic compounds, if not controlled, contribute to irritating pollutants such as smog and may in addition include some suspected or known carcinogens.

In addition, this condition can also lead to incomplete combustion of the remaining solid combustible materials in the waste which thwarts the object of the incineration process. It may leave residual ash, which, in some cases, may be a valuable worthless by-product, or a by-product of greatly reduced value. For example, in the case of paper sludge, approximately 50% of the solids consists of burnable cellulose and other organics with the remaining 50% being primarily calcium carbonate. If the calcium carbonate material is recovered in a clean and carbon-free condition, its value would be greatly enhanced and it would be marketable in many different applications. In the typical mass burn incineration processes, however, because of the poor combustion environment created by the moisture in the waste, it is uncommon for the ash to be clean and substantially free of carbon unless excessive use of auxiliary fuels or secondary, uneconomical, processing are utilized.

Existing systems have employed both direct and indirect heating/drying of the waste to prepare the waste for the actual combustion process. The direct fired system is the most common because of initial purchase and operating costs. In direct fired systems, the wastes are separated from the combustion process by indirect heating through some type of static heat transfer surface. Unfortunately, these systems are very expensive, and require a very large amount of transfer surface area, the surfaces tending to foul with the waste, which cuts down on their efficiency.

Existing direct fired incinerators for these types of materials are of three main categories: batch, parallel flow continuous and counterflow continuous. In the batch process, the waste is loaded into a furnace and combustion is started typically with auxiliary fuel. The process requires considerable auxiliary fuel in the beginning of the process because of the water that must be evaporated from the waste. Once the materials begin to dry, some of the materials will begin to evolve organic gases which in turn will burn. Control of this process is very difficult, because in the beginning, there is a deficit of available heat due to the moisture in the waste and, later in the process, there is often an excess of fuel available from this waste. The batch process can also lead to undesirable emissions during upset conditions.

Parallel flow continuous systems have the potential to solve the problems of control since the operation is on a continuous feed-in, feed-out basis. Because the flue gases flow through the furnace system in the same direction as the waste materials, substantial quantities of auxiliary fuels are required on a continuous basis to dry the waste for subsequent combustion. The steam that is generated from the drying process also flows into the combustion zone suppressing the combustion zone temperatures and the availability of the oxidant.

Counterflow continuous systems have been used where the waste materials move through the process in the opposite direction of the flue gases. In systems of this type, the hot exhaust gases from the incineration zone pass into the drying zone, allowing the waste heat to dry the material. The counterflow process has the advantage of requiring substantially less auxiliary fuel and provides a combustion zone for the most part that is free of the evaporated moisture from the waste. Unfortunately, the critical zone between drying and combustion cannot be carefully controlled and because of the elevated temperatures in this zone, organic gases can evolve. Because these gases are moving away from the combustion zone, they can be prevented from participating in the combustion process leaving the furnace with the remainder of the flue gases and evaporated moisture.

In accordance with the present invention, there is provided an efficient method for the drying and incineration of high moisture content waste materials which uses small quantities of auxiliary fuel and yet results in clean incineration without the emission of volatile organics from the stack gases and without the need in most cases, for a fume incinerator. When a fume incinerator is needed, only a small portion of the total gases require processing and this affords lower initial installation and operating costs. The process may also be used to dry materials that cannot be heated directly by flame and, because of their characteristics, do not lend themselves well to conventional indirect heating methods.

Consistent with the foregoing, the present invention identifies the major problem in the prior methods and apparatus for incineration of wastes as the failure to recognize that, before the combustible materials can be burned, the water in the materials must be substantially evaporated into steam. Unfortunately, when this is done in the presence of combustion, it is very difficult to control. Not only is moisture evolved into steam, but also, as the temperature rises, volatile organic compounds can be generated. These can be consumed in the incineration process if sufficient time, heat and oxygen is available, but because of the high moisture/steam environment around the waste, the conditions for efficient combustion are not available.

In accordance with the present invention, the drying and combustion zones have been separated and a surrogate heat transfer medium is provided which uses the heat of the combusting waste material to dry the waste material before combustion. The surrogate heat transfer medium may be stone, metal pellets or balls, or other minerals such as refractory pieces. Any material could be used which is thermally stable, has a sufficiently high specific heat, is non-combustible, and is significantly different from the dried waste in its density, size or both. The invention herein may use any one of different furnace types including but not limited to fluidized bad, rotary multiple hearth or horizontal rotary dryer or kiln. The preferred embodiment, however, is the rotary counterflow dryer/kiln. For clarity, an inclined rotary counterflow dryer will be used in the following description of the process, recognizing that other furnace types may be employed in the process.

Particularly, the counterflow rotary drum has an inlet at its elevated end, a heating zone into which a burner directs its flame with the hot gases of combustion flowing toward the inlet end of the drum, and a downstream drying zone separated from the heating zone and flame by a partition, the drying zone having a waste material inlet, a steam and entrained waste material outlet and a discharge for the surrogate heat transfer medium and large particles of waste material. In use, the surrogate medium, e.g., stone, enters the heating zone of the dryer at the exhaust gas (inlet) end of the dryer. This material flows in a countercurrent direction and in heat transfer relation with respect to the exhaust gases. In this way, the coldest stone is in contact with the final exhaust gases leaving the dryer, providing the lowest possible exhaust gas temperature, as the stone moves toward the burner of the dryer progressively getting hotter and hotter. The stone then passes through the actual combustion zone of the heating zone and is discharged from the heating zone past the partition between the heating and drying zones and into the drying zone. The hot surrogate medium, e.g., the stone, upon entering the drying zone, is immediately mixed in direct contact heat transfer relation with the cold, wet waste materials inlet directly to the drying zone. This drying zone is kept separate from the heating zone by physical barriers, such as the partition, and by control of the draft in the two zones, such that equal pressures are maintained in the two zones.

In the drying zone, water in the waste will immediately evaporate to steam, drying the waste. At the same time, the heated medium, e.g., stone, will be giving up the heat energy that was stored in it and the stone's temperature will fall. The stone and waste will move away from the transfer point, i.e., their initial inlets to the drying zone, along with the steam which is being generated, such movement being cocurrent. As the materials move through the drying zone, they are continuously agitated and mixed, in this instance by rotation of the drum, which enhances the heat transfer between the stone and waste.

Because the wet waste is generally heavy, it will not initially become entrained in the generated steam. However, as the waste dries, it will become lighter and will become airborne due to the agitation of the materials in the drying zone. As the stone and waste moves through the drying zone, more water in the waste is continuously given up by the waste, and converted into steam. Because the steam is moving in the same direction as the waste, the velocity of the gases in the drying zone progressively increases, enhancing the carry-out of the dried material. The steam carrying the airborne dried wastes flows from the drying zone to a primary separator, e.g., a baghouse. In the separator, these dried materials are collected on a continuous basis. Concomitantly, the now cooled stone will move to the discharge at the end of the drying zone and will be discharged along with some larger pieces of the waste that do not become airborne.

The dried material collected in the primary separator are then returned to the combustion zone of the dryer, preferably by air transport, where the dried material is incinerated. Because this combustion zone is supplied with pre-dried materials without the steam blanket found in other systems, substantially complete combustion of the dried waste occurs, releasing a clean ash product, free of carbon or other unburned organics. As will be appreciated, the burning dried waste also heats the stone being carried through the heating zone of the dryer. The ash from the waste combustion becomes even smaller in size and lighter and becomes airborne in the flue gases formed by the combustion of the waste and any auxiliary fuel. This powder-like ash is carried through the dryer exhausting into a secondary particulate collection device, i.e., a separator, such as a secondary baghouse.

The quantities of waste material and the surrogate medium in the dryer can be controlled by the draft maintained on the drying zone close to the stone discharge chute, preferably by the reintroduction of steam discharged from the baghouse exhaust fan back up through the discharge chute. By controlling the amount of recirculated steam, the quantity of waste carried out with the stone can be controlled. Steam taken from the baghouse exhaust fan discharge can also be used to produce an inert gas seal on the surfaces separating the rotary drum from the stationary members supporting the drum. The steam may thus be beneficially used to maintain the environment around the dried or drying waste free of oxidants which may otherwise cause premature combustion of the materials.

In some cases, it may be desirable to recover the larger pieces of waste carried out with the stone because these may be recycled into other useful products. The surrogate medium, e.g., the stone, and any residual material may therefore be further separated external to the dryer using screens, air separation devices or other appropriate devices. In any case, all or a portion of the surrogate medium, having cooled, may be recirculated to the inlet of the primary drum.

Further in this respect, the process may also be used on waste or other mineral products that need only be dried so that the materials may be recovered in more usable form. Some such products do not lend themselves to drying with direct flame and, because of their physical properties, can cause problems in conventional heat transfer devices, i.e., fouling the heat transfer surfaces. Utilizing the present invention, such products may be collected in the primary separator which receives the steam and entrained products from the drying zone, or separated from the discharged stone or both.

In most cases, the steam generated from the drying zone and separated from the dried waste in the primary separator may be finally expelled therefrom to the atmosphere without further treatment. With some wastes which contain very low boiling point organics or biological hazards, however, the separated steam may be passed through a fume incinerator to ensure destruction of the VOCs or any pathogens. Since this is only a small fraction of the total flue gas stream generated by the process, a significantly smaller fume incinerator may be utilized with its lower initial purchase and operating costs.

In many cases, the fume incinerator can be completely eliminated by controlling the temperature of the surrogate medium entering the drying zone and by controlling the ratio of the tons of waste processed per unit time as compared to the tons of medium, e.g., stone being continuously recirculated during the process. Generally, lower stone temperatures can be used when the ratio of stone to waste increases. The stone temperature at the point where it enters the drying zone may be controlled at a temperature where it would not cause the evolution of organic gases from the waste, but would be sufficiently high to dry the waste.

Additionally, make-up stone may be added to the process, in the form of ambient temperature stone as required to control the temperature of the secondary baghouse or other collection device which receives the gases from the heating zone. The total weight of stone being recirculated could be controlled by "wasting" a portion in the same amount as the make-up stone mass. It may be necessary to make up a certain amount of the stone used in each cycle because of degradation of the stone itself. The repeated heating and cooling of the stone in the process may lead to fracture of the stone, causing smaller pieces to be created. These are screened off in the discharged material and fresh virgin materials are added to make up this loss.

While the invention describes the use of a single drum or furnace divided into two zones, the invention may employ more than two zones substantially performing the same functions as described. Additionally, two or more drums may be used, connecting them with appropriate gas and material transfer devices to substantially have them operate in the same manner as described.

In another embodiment, the invention may be used to perform soil remediation of very fine or silt materials. These materials can be difficult to remediate in conventional systems because of the difficulty of handling the tremendous amounts of dust which become mixed with the combustion products. This would be applicable where the surrogate temperatures would be sufficiently high and the ratios of silt to surrogate such that not only would the moisture in the silt be driven off, but also the organics. The off gases from the drying section, after passing through the collector, then could be either incinerated or condensed. If sealed properly, substantially all of the off gases would be condensible as they generally comprise oil or other condensible contaminant and water vapor.

In a preferred embodiment according to the present invention, there is provided, in a waste incinerator system having a heating zone, a drying zone and a separator, a method for incinerating high moisture content waste material comprising the steps of heating a surrogate heat transfer medium having a high specific heat by contact with hot gases of combustion from a combustion source supplying heat to the heating zone such that the surrogate medium is capable of generating steam when placed in heat transfer relation with the high moisture content waste material in the drying zone, placing the high moisture content waste material and the heated surrogate medium in heat transfer relation one with the other in the drying zone such that at least some of the moisture of the waste material is evaporated to steam and the waste material is dried, agitating the waste material and surrogate medium when in heat transfer relation with one another in the drying zone to entrain a first portion of the dried waste material in the steam, separating the steam and the first portion of the dried waste material one from the other in the separator, conveying the separated first portion of the dried waste material to the combustion source to serve as a fuel for combustion and generation of the hot gases thereof and discharging the separated steam from the separator.

In a further preferred embodiment according to the present invention, there is provided, in a waste incinerator system having a rotary drum including a heating zone, a drying zone and a burner between the zones for generating hot gases of combustion, a method of incinerating high moisture content waste material comprising the steps of flowing surrogate heat transfer medium in the heating zone of the drum in countercurrent heat transfer relation to the flow of the hot gages of combustion, introducing the heated surrogate medium into the drying zone for flow therethrough, introducing the high moisture content waste material into the drying zone for cocurrent flow with the high moisture content waste material in the drying zone, rotating the drum to enhance the heat transfer relation between the hot gases of combustion and the surrogate medium in the heating zone and between the heated surrogate medium and the high moisture content waste material in the drying zone such that at least some of the moisture of the waste material in the drying zone is evaporated into steam and the waste material is dried, the rotation of the drum also causing a first portion of the waste material dried in the drying zone to become entrained in the steam in the drying zone, separating the steam and the first portion of the dried waste material one from the other in a separator, conveying the separated first portion of the dried waste material to the burner to serve as fuel for the burner for the generation of the hot gases of combustion and discharging the separated steam from the separator.

Accordingly, it is a primary object of the present invention to provide an efficient method for the incineration of high moisture content organic waste materials which uses small quantities of auxiliary fuel and results in substantially clean incineration without the emission of volatile organics from stack gases.

These and further objects and advantages of the present invention will become more apparent upon reference to the following specification, appended claims and drawings.

BRIEF DESCRIPTION OF THE DRAWING FIGURES

FIG. 1 is a schematic illustration of an organic waste incinerator according to the present invention; and FIG. 2 is a schematic illustration of a further form of a rotary drum dryer used in the waste incineration system hereof.

DETAILED DESCRIPTION OF THE DRAWING FIGURES

Reference will now be made in detail to a present preferred embodiment of the invention, an example of which is illustrated in the accompanying drawings.

Figure 1:
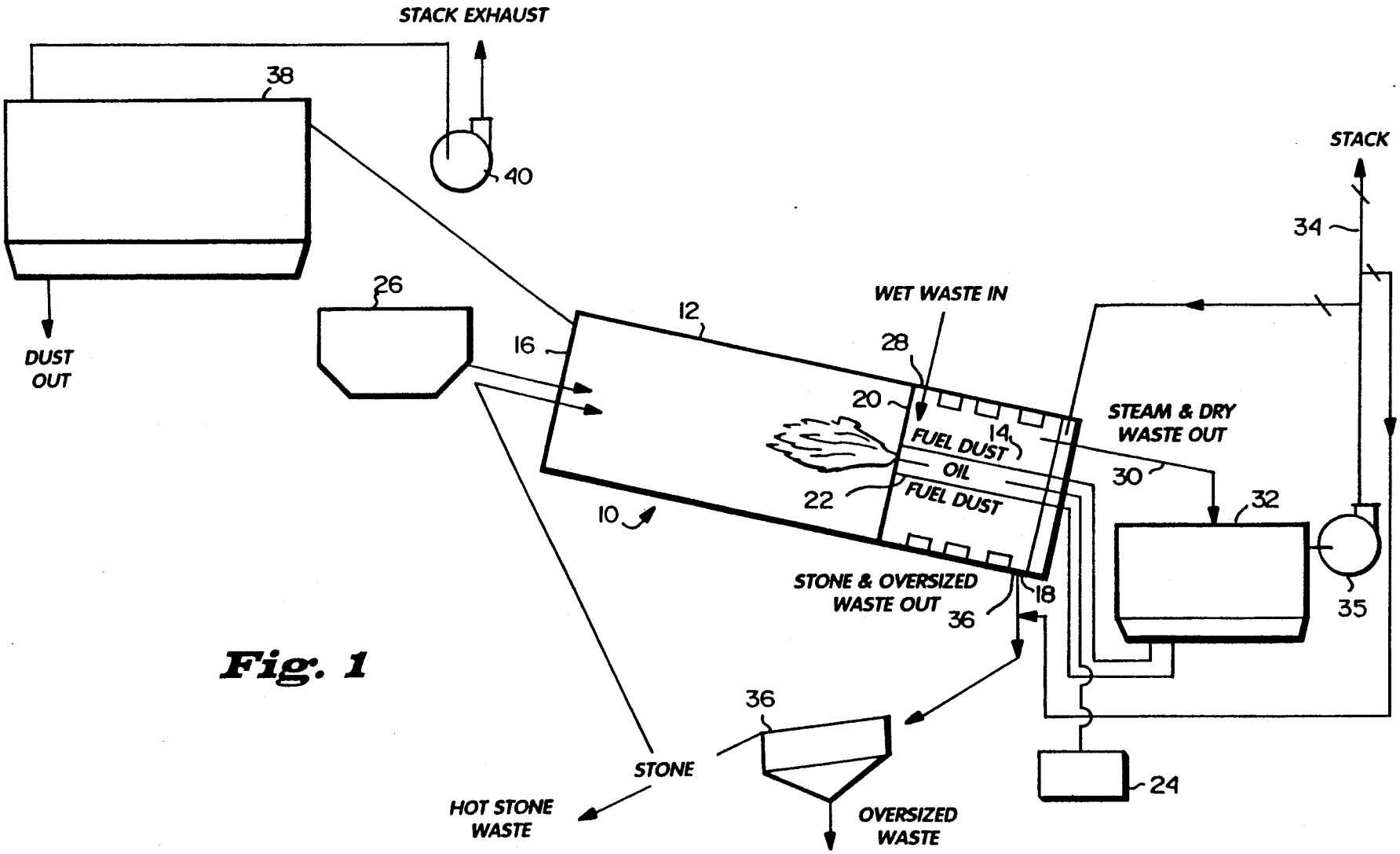

Referring now to the drawings, particularly to FIG. 1, there is illustrated an incineration system according to the present invention comprising a furnace divided into heating and drying zones, in this instance, a rotary drum dryer generally designated 10 having a heating zone 12 and a drying zone 14. The drum dryer is preferably inclined, having an inlet end 16 elevated from a discharge end 18. The heating and drying zones 12 and 14, respectively, are partitioned one from the other by a wall 20 through which extends the head of a burner 22 for directing flame and hot gases of combustion in a direction toward the inlet end 16 of drum dryer 10. Partition wall 20 is designed to enable materials flowing along the drum to pass from the heating zone into the drying zone without exposing the materials to be dried directly to the flame of the burner or to the hot gases of combustion generated thereby. Burner 22 extends axially through the drying zone 14 and is connected with an auxiliary fuel source 24, such as an oil or natural gas supply, as well as a source of fuel comprising the dried waste as set forth in the ensuing description. The interior wall surfaces of the drum 10 are provided with flighting to lift materials and veil the materials within the heating and drying zones of the drum dryer as needed and except in the area of the flame.

A surrogate heat transfer medium of high specific heat is supplied the inlet end 16 of drum 10 from a hopper 26. While the heat transfer medium may comprise any one or a combination of a number of materials having high specific heat, stone is a preferred medium which has a specific heat of about 0.2 BTU/lb/°F. Thus, stone is supplied from hopper 26 through inlet end 16 for flow along the downwardly inclined drum dryer in counterflow relation to the hot gases of combustion flowing from the burner 22 toward the inlet end 16. The veiling action of the flights, not shown, of the dryer causes efficient heat transfer from the hot gases to the stone heating the stone which then passes through the separation wall 20 into the drying zone. The drying zone has an inlet 28 for admitting high moisture content waste material. Due to the rotation of the drum, the wet waste material and the hot surrogate medium are thoroughly mixed together, with the cold wet waste material receiving heat from the surrogate medium. The surrogate medium has sufficient temperature to cause the water of the waste material to evaporate to steam. Additionally, agitation of the waste material and surrogate medium causes the waste material to break up into smaller particles and waste material becomes entrained in the steam. It will be appreciated that with this arrangement, the wet waste material does not come into direct contact with the flame or the hot gases of combustion in the heating zone of drum 10 but has only indirect heat transfer relation with the heated surrogate medium.

The steam containing the entrained waste is removed from the drying zone via a conduit 30 and input to a separator 32, preferably a baghouse. Baghouse 32 is conventional in construction having a plurality of bags having open upper ends and depending from a horizontal plate. The steam and entrained waste enters the baghouse below the plate, with the steam passing through the bags and the dried particulate waste being separated therefrom and collected. The dried collected waste is then transferred from the baghouse 32 by a blower, not shown, and supplied to the burner 22, where it serves as fuel for the burner. The steam separated from the dried waste exits the baghouse 32 for delivery to a stack 34 via an exhaust fan 35.

The drying zone 14 also includes a discharge chute 36 through which the surrogate heat transfer medium and large particles of waste materials are removed from the drying zone 14. The combined surrogate medium and large particles of waste are separated in a separator, for example, a screen 37. In those instances where the large particles of waste may constitute valuable products, those separated oversized waste materials are collected for use. The stone, in whole or in part, may be recycled back to the inlet end 16 of the drum 10 for reuse. The quantity of the waste carried out of the drying zone with the surrogate medium at discharge 36 can be controlled by the opposing flow of gases being pushed or pulled into the drying zone 14. A smaller or larger portion of the steam exiting the baghouse 32 may be directed into the discharge chute 36 to recirculate particulate waste, which otherwise might be discharged through discharge 36, and back into drying zone 14. This additional steam circulation will tend to increase the gas velocities in the drying section, carrying more and larger pieces of the waste to the collector.

The exhaust gases from the heating zone 12 are provided a secondary separator 38, preferably a baghouse, where particulate matter is separated from the exhaust gases. The clean exhaust gases are then exhausted by a fan 40 through a stack. The particulate matter is collected for disposal.

In a particular preferred embodiment of the present invention, the surrogate heat transfer medium is input to the inlet end of the drum dryer from the hopper 26 at ambient temperature, or up to the temperature of the stone discharge at point 36. The temperature of the surrogate heat transfer medium is preferably adjusted at the entry point 16 by blending with ambient temperature medium from hopper 26, or by cooling using water prior to the introduction. The temperature of the material may be adjusted to control the temperature of gases to the collection device. It is also important to control the temperature of the surrogate medium at its transfer point into the drying zone 14 and the medium is transferred at a preferred temperature within a range of about 600°-900° F. Upon mixing and agitation with the wet waste in the drying zone 14, the combined steam and entrained waste are delivered from the drying zone 14 at a temperature, preferably approximately 200°-250° F. to the separator 32. The combined surrogate medium and large-sized waste exiting the drying zone 14 at discharge 36 has a temperature preferably in a range of 250°-300° F. The exhaust gases from the inlet end 16 of the drum dryer 10 are typically within a range of 200°-450° F. The temperature of those exhaust gases is controlled in part by the quantity of hot surrogate material recycled from the separator 36 into the inlet 16. This is significant depending upon the type of separator 38 utilized. For example, if a baghouse is utilized having Teflon and fiberglass bags, those bags can withstand a temperature of 550° F. Polyester bags, however, can withstand only a temperature of 190°-200° F., whereas bags formed of Nomex can withstand temperatures up to 375° F. It will also be appreciated that in the discussion of dried material, the dried material still has a moisture content, for example, of about 10% of the weight of the material. Thus, reductions from 50 to 60% moisture content down to about 10% moisture content before incineration are provided.

Figure 2:
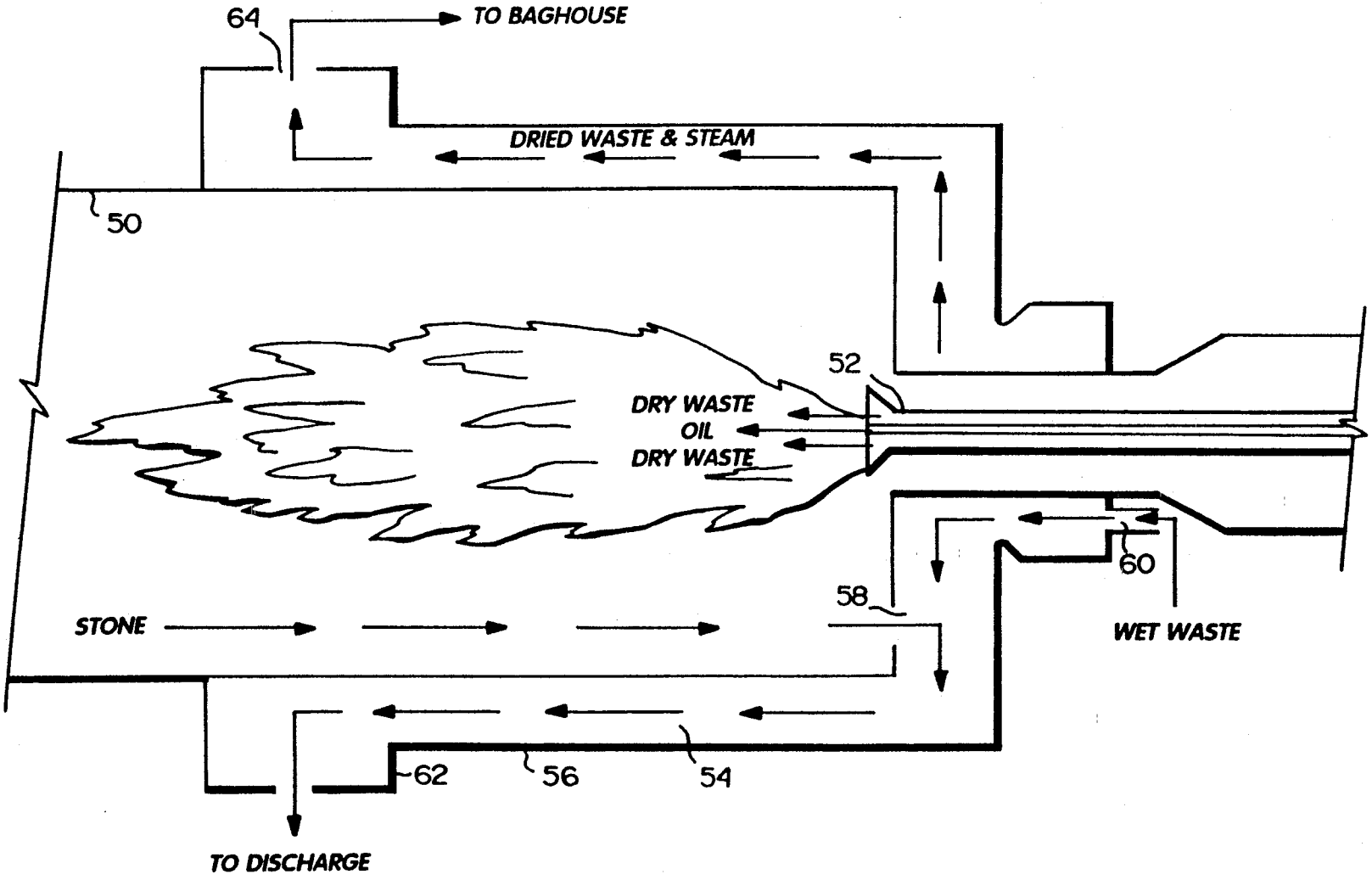

Referring now to FIG. 2, there is illustrated a further form of rotary drum dryer which may be used in the present invention. In this dryer, the surrogate medium is input to an inlet end of an inner drum 50 for flow toward the burner 52 and flame. The heated surrogate medium is transferred into the annular space 54 between the inner drum 50 and an outer drum 56 through a discharge opening 58 in the end of the inner drum 50. A wet waste inlet 60 is also provided in that end of the drum to deliver wet waste into the annular space 54 for cocurrent flow with the heated surrogate medium to a discharge 62. The agitation caused by the rotation of the drum and the mixing of the waste material and surrogate medium causes the surrogate medium to evaporate the moisture of the wet waste to steam and to entrain the particles of wet waste. Those entrained particles and steam are delivered from an outlet 64 from the annular space 54 for delivery to a separator such as the bag 32 illustrated in the prior embodiment. It will be appreciated that in this form, as in the previous form, the wet waste material does not contact the flame or the hot gases of combustion while, simultaneously, the moisture content of the wet waste is substantially reduced once separated in the baghouse.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a waste incinerator system having a rotary drum including a heating zone, a drying zone and a burner between said zones for generating hot gases of combustion, a method of incinerating high moisture content waste material comprising the steps of:

flowing surrogate heat transfer medium in said heating zone of said drum in countercurrent heat transfer relation to the flow of the hot gases of combustion;

introducing the heated surrogate medium into the drying zone for flow therethrough;

introducing the high moisture content waste material into the drying zone for cocurrent flow with the high moisture content waste material in the drying zone;

rotating the drum to enhance the heat transfer relation between the hot gases of combustion and the surrogate medium in the heating zone and between the heated surrogate medium and the high moisture content waste material in the drying zone such that at least some of the moisture of the waste material in the drying zone is evaporated into steam and the waste material is dried, the rotation of the drum also causing a first portion of the waste material dried in said drying zone to become entrained in the steam in said drying zone;

separating the steam and the first portion of the dried waste material one from the other in a separator;

conveying the separated first portion of the dried waste material to the burner to serve as fuel for the burner for the generation of the hot gases of combustion; and discharging the separated steam from the separator.

2. A method according to claim 1 including locating the heating and drying zones of the drum at axially spaced positions along said drum.

3. A method according to claim 1 including locating the heating and drying zones of the drum at concentric positions axially about said drum.

4. A method according to claim 1 including the step of discharging the surrogate medium from the drying zone.

5. A method according to claim 4 including the step of recycling at least a portion of the surrogate medium discharged from the drying zone into the heating zone for heating thereof and passage through the drying zone.

6. A method according to claim 1 including the steps of discharging the surrogate medium and a second portion of the waste material not entrained in the steam in the drying zone from the drying zone, introducing at least a portion of the separated steam discharged from the separator into the second portion of the waste material discharged from the drying zone to entrain waste material therein in the separated steam portion and reintroduce the second portion of the waste material entrained in the separated steam portion into the drying zone.

7. A method according to claim 1 including the step of discharging the surrogate medium and a second portion of the waste material not entrained in the steam in the drying zone from the drying zone, and separating the discharged surrogate medium and the second portion of waste material one from the other.

8. A method according to claim 1 including the step of controlling the temperature of the heated surrogate medium placed in heat transfer relation with the high moisture content waste material.

9. A method according to claim 1 including the step of passing the hot gases of combustion through a second separator to generate clean exhaust gases and particulate matter.

10. A method according to claim 1 wherein the high moisture content material comprises a very fine or slit-like soil material having organics contained therein, the further step of heating the surrogate heat transfer medium to a temperature sufficient, when in contact with the soil material, to drive off the organics from the soil, and collecting the driven-off organics.

11. A method according to claim 1 including the step of isolating the drying zone from the heating zone such that the generation of the hot gases of combustion by the burner is isolated from the drying zone whereby steam in the drying zone does not substantially affect the generation of hot gases of combustion by the burner.

12. In a waste incinerator system having a heating zone, a drying zone and a separator, a method for incinerating high moisture content waste material comprising the steps of:

heating a surrogate heat transfer medium having a high specific heat by contact with hot gases of combustion from a combustion source supplying heat to the heating zone such that the surrogate medium is capable of generating steam when placed in heat transfer relation with the high moisture content waste material in the drying zone;

placing the high moisture content waste material and the heated surrogate medium in heat transfer relation one with the other in the drying zone such that at least some of the moisture of the waste material is evaporated to steam and the waste material is dried;

agitating the waste material and surrogate medium when in heat transfer relation with one another in the drying zone to entrain a first portion of the dried waste material in the steam;

separating the steam and the first portion of the dried waste material one from the other in the separator;

conveying the separated first portion of the dried waste material to the combustion source to serve as a fuel for combustion and generation of the hot gases thereof;

discharging the separated steam from the separator;

discharging the surrogate medium from the drying zone; and recycling at least a portion of the surrogate medium discharged from the drying zone into the heating zone for heating thereof and passage through the drying zone.

13. A method according to claim 12 including the steps of controlling the temperature of the heated surrogate medium placed in heat transfer relation with the high moisture content waste material.

14. A method according to claim 12 wherein the high moisture content material comprises a very fine or silt-like soil material having organics contained therein, the further step of heating the surrogate heat transfer medium to a temperature sufficient, when in contact with the soil material, to drive off the organics from the soil, and collecting the driven-off organics.

15. A method according to claim 12 including the step of isolating the drying zone from the heating zone such that the generation of the hot gases of combustion by the burner is isolated from the drying zone whereby steam in the drying zone does not substantially affect the generation of hot gases of combustion by the burner.

16. A method according to claim 12 including controlling the temperature of the hot gases of combustion exiting the heating zone by regulating the quantity of surrogate medium recycled into the heating zone.

17. In a waste incinerator system having a heating zone, a drying zone and a separator, a method for incinerating high moisture content waste material comprising the steps of:

heating a surrogate heat transfer medium having a high specific heat by contact with hot gases of combustion from a combustion source supplying heat to the heating zone such that the surrogate medium is capable of generating steam when placed in heat transfer relation with the high moisture content waste material in the drying zone;

placing the high moisture content waste material and the heated surrogate medium in heat transfer relation one with the other in the drying zone such that at least some of the moisture of the waste material is evaporated to steam and the waste material is dried;

agitating the waste material and surrogate medium when in heat transfer relation with one another in the drying zone to entrain a first portion of the dried waste material in the steam;

separating the steam and the first portion of the dried waste material one from the other in the separator;

conveying the separated first portion of the dried waste material to the combustion source to serve as a fuel for combustion and generation of the hot gases thereof;

discharging the separated steam from the separator; and discharging the surrogate medium and a second portion of the waste material not entrained in the steam in the drying zone from the drying zone, introducing at least a portion of the separated steam discharged from the separator into the second portion of the waste material discharged from the drying zone to entrain waste material therein in the separated steam portion and reintroduce the second portion of the waste material entrained in the separated steam portion into the drying zone.

18. In a waste incinerator system having a heating zone, a drying zone and a separator, a method for incinerating high moisture content waste material comprising the steps of:

heating a surrogate heat transfer medium having a high specific heat by contact with hot gases of combustion from a combustion source supplying heat to the heating zone such that the surrogate medium is capable of generating steam when placed in heat transfer relation with the high moisture content waste material in the drying zone;

placing the high moisture content waste material and the heated surrogate medium in heat transfer relation one with the other in the drying zone such that at least some of the moisture of the waste material is evaporated to steam and the waste material is dried;

agitating the waste material and surrogate medium when in heat transfer relation with one another in the drying zone to entrain a first portion of the dried waste material in the steam;

separating the steam and the first portion of the dried waste material one from the other in the separator;

conveying the separated first portion of the dried waste material to the combustion source to serve as a fuel for combustion and generation of the hot gases thereof;

discharging the separated steam from the separator; and discharging the surrogate medium and a second portion of the waste material not entrained in the steam in the drying zone from the drying zone, and separating the discharged surrogate medium and the second portion of waste material one from the other.

19. In a waste incinerator system having a heating zone, a drying zone and a separator, a method for incinerating high moisture content waste material comprising the steps of:

heating a surrogate heat transfer medium having a high specific heat by contact with hot gases of combustion from a combustion source supplying heat to the heating zone such that the surrogate medium is capable of generating steam when placed in heat transfer relation with the high moisture content waste material in the drying zone;

placing the high moisture content waste material and the heated surrogate medium in heat transfer relation one with the other in the drying zone such that at least some of the moisture of the waste material is evaporated to steam and the waste material is dried;

agitating the waste material and surrogate medium when in heat transfer relation with one another in the drying zone to entrain a first portion of the dried waste material in the steam;

separating the steam and the first portion of the dried waste material one from the other in the separator;

conveying the separated first portion of the dried waste material to the combustion source to serve as a fuel for combustion and generation of the hot gases thereof;

discharging the separated steam from the separator; and causing the surrogate medium and the waste material in the drying zone to flow in cocurrent relation one with the other.

20. A method according to claim 19 wherein the high moisture content material comprises a very fine or slit-like soil material having organics contained therein, the further step of heating the surrogate heat transfer medium to a temperature sufficient, when in contact with the soil material, to drive off the organics from the soil, and collecting the driven-off organics.

21. In a waste incinerator system having a heating zone, a drying zone and a separator, a method for incinerating high moisture content waste material comprising the steps of:

heating a surrogate heat transfer medium having a high specific heat by contact with hot gases of combustion from a combustion source supplying heat to the heating zone such that the surrogate medium is capable of generating steam when placed in heat transfer relation with the high moisture content waste material in the drying zone;

placing the high moisture content waste material and the heated surrogate medium in heat transfer relation one with the other in the drying zone such that at least some of the moisture of the waste material is evaporated to steam and the waste material is dried;

agitating the waste material and surrogate medium when in heat transfer relation with one another in the drying zone to entrain a first portion of the dried waste material in the steam;

separating the steam and the first portion of the dried waste material one from the other in the separator;

conveying the separated first portion of the dried waste material to the combustion source to serve as a fuel for combustion and generation of the hot gases thereof;

discharging the separated steam from the separator; and passing the hot gases of combustion through a second separator to generate clean exhaust gases and particulate matter.

* * * * *